US005346228A

United States Patent [19]

Offutt

[11] Patent Number: 5,346,228

[45] Date of Patent: Sep. 13, 1994

[54] SOCCER GOAL AND GAMING APPARATUS

[75] Inventor: James C. Offutt, Evanston, Ill.

[73] Assignee: Rimball Marketing and Development, Inc., Evanston, Ill.

[21] Appl. No.: 111,648

[22] Filed: Aug. 25, 1993

[51] Int. Cl.[5] ..... A63B 63/02

[52] U.S. Cl. ..... 273/402; 273/1.5 R

[58] Field of Search ..... 273/398, 396, 400, 401, 273/402, 411, 1.5 R, 1.5 A, 26 A

[56] References Cited

U.S. PATENT DOCUMENTS

| | | | |
|---|---|---|---|
| 1,258,931 | 3/1918 | Newcombe | 273/402 |
| 2,545,615 | 3/1946 | Hatley | 273/402 |
| 2,932,516 | 4/1960 | Penner | 273/1.5 R X |
| 2,986,398 | 5/1961 | Oliver | 273/26 A X |
| 3,421,764 | 6/1965 | Smith et al. | 273/402 |
| 4,057,252 | 11/1977 | Pelton | 273/400 |
| 4,258,924 | 3/1981 | Ketchum | 273/411 |
| 4,260,154 | 4/1981 | Balbastro | 273/411 |
| 4,286,786 | 9/1981 | Papadopoulos | 273/396 |
| 4,703,931 | 11/1987 | Steen | 273/26 A |
| 4,762,319 | 8/1988 | Krumholz | 273/1.5 R |
| 4,828,270 | 5/1989 | Chaing | 273/401 |
| 4,932,657 | 6/1990 | Hailer et al. | 273/26 A |
| 5,000,461 | 3/1991 | Borazjani | 273/401 |
| 5,054,791 | 10/1991 | Ball | 273/396 |
| 5,181,725 | 1/1993 | Leras et al. | 273/402 |
| 5,217,230 | 6/1993 | Judd | 273/401 |

*Primary Examiner*—William H. Grieb

*Attorney, Agent, or Firm*—McAndrews, Held & Malloy, Ltd.

[57] ABSTRACT

A soccer ball goal facilitates practice of kicking drills and play of a soccer ball game by a reduced number of players. The soccer ball goal comprises a hoop having a circular aperture large enough to admit passage of a soccer ball. A backboard has a front face which at least as large as the circular aperture of the hoop. A frame rigidly connects the hoop to the backboard. The frame is adapted to maintain the hoop in a position which is in front of the backboard front face, parallel to the backboard front face, and at predetermined distance from the backboard front face. A playing surface engaging means maintains the backboard substantially perpendicular to the playing surface. A ricochet board can be positioned to facilitate rebounded shots into the soccer ball goal. The ricochet board comprises a second backboard having a front face and second playing surface engaging means for maintaining said backboard substantially perpendicular to the playing surface and permitting the second backboard to be movably positioned relative to said soccer ball goal.

25 Claims, 6 Drawing Sheets

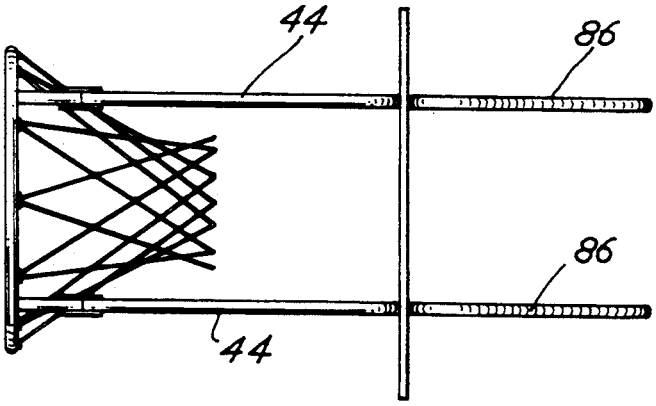
Fig. 4
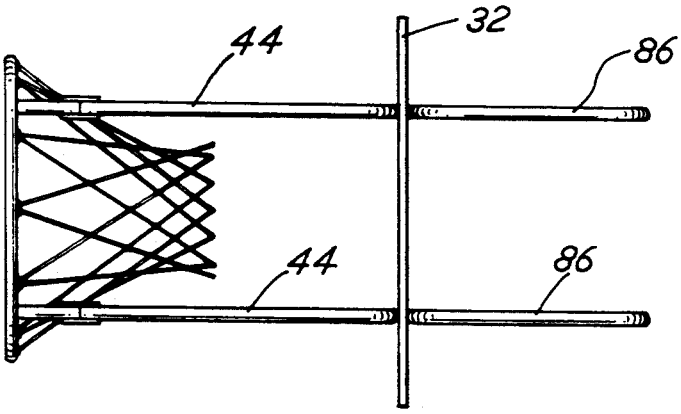
Fig. 5
Fig. 6
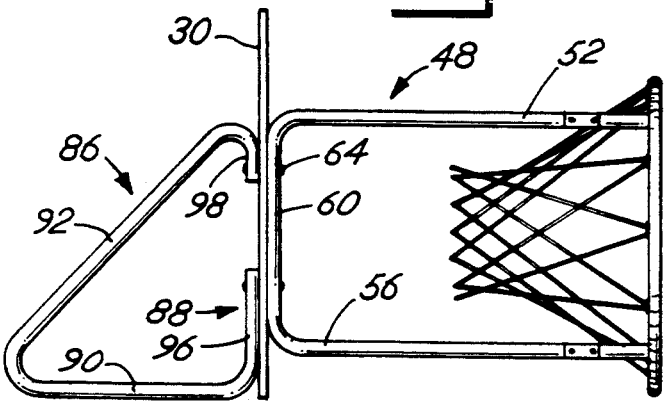
Fig. 7
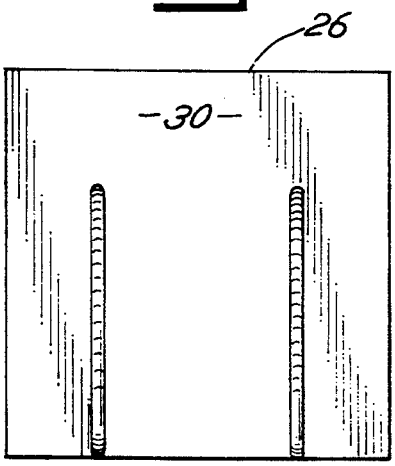

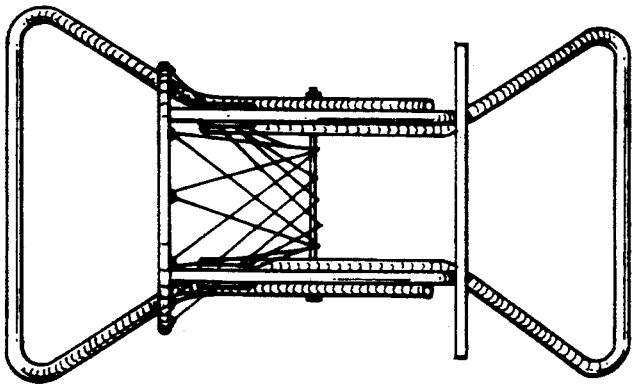
Fig. 19
Fig. 21
Fig. 20
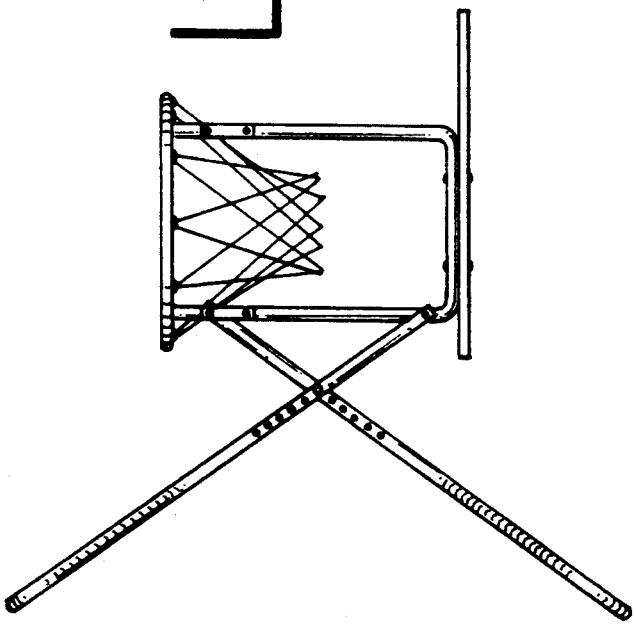
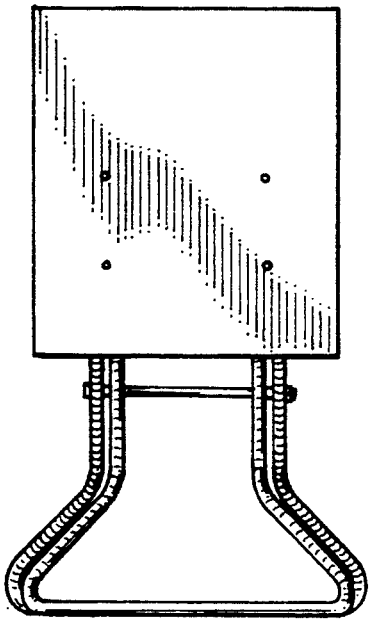
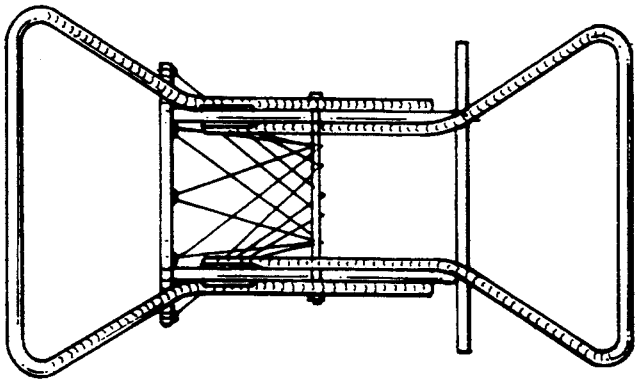
Fig. 22

SOCCER GOAL AND GAMING APPARATUS

FIELD OF THE INVENTION

The present invention relates to a sport training device and, more particularly, to a soccer ball goal and gaming apparatus for improving soccer skills.

BACKGROUND OF THE INVENTION

Soccer has long been one of the most popular sports in the world and especially in Europe and Central America. Recently, the sport has become more popular in the United States due to media coverage and children's soccer leagues which expose individuals to the sport at a young age. Regularly playing soccer is beneficial because it increases one's motor skills and provides an excellent cardiovascular workout. In addition, many individuals prefer soccer to other sports because it can be played competitively by individuals of various physical stature and presents less risk of physical injury than contact sports such as football.

The object of a soccer game is to score points by kicking a ball into an opponent's goal. Soccer goals generally comprise a framework made of two vertical uprights connected at their top by a horizontal member (called a cross bar) to define a rectangular goal opening whose longer sides are parallel to the playing surface. Scoring goals requires the ability to accurately and consistently kick the soccer ball into the soccer goal. One of the best ways to develop kicking skills is through the repetition of kicking drills.

Soccer players typically practice their kicking skills by kicking a ball into a standard soccer goal. However, the large size of a soccer goal limits number of locations where a goal can be used and makes it is difficult to transport the goal to remote locations. Practicing with a standard soccer goal is also undesirable because the goal does not provide a reduced-sized target for developing precise aiming skills.

Several devices have been developed to aid soccer players in developing their kicking skills. However, these devices typically resemble soccer goals or are used in connection with an actual soccer goal and, hence, suffer from the above-noted problems.

Another way to develop soccer skills is to play competitive soccer on a regular basis. Unfortunately, the large size of a soccer playing field makes it difficult for many individuals to regularly play soccer. In particular, the large size of a soccer field greatly limits the number of locations which can be utilized as a soccer field. As a result, many individuals do not have access to soccer facilities or they must travel a significant distance to such facilities.

The size of the soccer goal is also a factor which discourages many individuals from playing soccer on a regular basis. The goal's large size essentially makes it meaningless to play soccer unless a goalie stands guard a the goal and attempts to block shots from the opposing team. This is especially true if only two individuals want to play soccer. Even if several players are available, it still may be difficult to find someone who is willing to play goalie because the goalie is not involved in the "action" during much of the game.

The present invention is directed to overcoming one or more of the above-noted problems.

In particular, it is an object of the present invention is to provide a soccer ball goal that is portable and compact.

Another object of the present invention is to provide a soccer ball goal which is inexpensive to manufacture.

Yet another object of the present invention is to provide a soccer ball goal that provides a reduced target area for practicing kicking drills.

A further object of the present invention is to provide a soccer ball goal that makes practicing kicking drills more fun and more challenging.

Still a further object of the present invention is to provide a soccer ball goal that is height adjustable.

An additional object of the present invention is to provide a soccer style game that can be played with a reduced number of players.

It is another object of the present invention to provide a soccer style game that can be played by as few as two individuals.

Still another object of the present invention to provide a soccer style game that can be played without a goalie.

It is another object of the present invention to provide a soccer style game that can be played on a reduced playing field.

SUMMARY OF THE INVENTION

In accordance with an aspect of the present invention a soccer ball goal comprises a hoop having a circular aperture large enough to admit passage of a soccer ball. A backboard has a front face which is at least as large as the circular aperture of the hoop. A frame rigidly connects the hoop to the backboard. The frame is adapted to maintain the hoop in a position that is in front of the backboard front face, parallel to the backboard front face, and at predetermined distance from the backboard front face. A playing surface engaging means maintains the backboard and the hoop substantially perpendicular to the playing surface.

According to another aspect of the present invention, a gaming apparatus comprises at least one soccer ball goal and at least one ricochet board that is movable with respect to the soccer ball goal. The soccer ball goal includes a hoop having a circular aperture large enough to admit passage of a soccer ball. A backboard has a front face which at least as large as the circular aperture of the hoop. A frame rigidly connects the hoop to the backboard. The frame is adapted to maintain the hoop in front of the backboard front face, parallel to the backboard front face, and at predetermined distance from the backboard front face. A playing surface engaging means maintains the backboard substantially perpendicular to the playing surface. The ricochet board includes a second backboard having a front face and second playing surface engaging means for maintaining the backboard substantially perpendicular to the playing surface and permitting the second backboard to be movably positioned relative to the soccer ball goal.

Other objects and advantages of the invention will become apparent upon reading the following detailed description and appended claims, and upon reference to the accompanying drawings.

BRIEF DESCRIPTION OF THE DRAWINGS

For a more complete understanding of this invention reference should now be had to the embodiment illustrated in greater detail in the accompanying drawings and described below by way of example of the invention.

In the drawings:

FIG. 4 is a top view of the soccer ball goal of FIG. 1;

FIG. 5 is a bottom view of the soccer ball goal of FIG. 1;

FIG. 6 is a left side view of the soccer ball goal of FIG. 1;

FIG. 7 is a rear view of the soccer ball goal of FIG. 1;

FIG. 19 is a top view of the height adjustable soccer ball goal of FIG. 15;

FIG. 20 is a right side view of the height adjustable soccer ball goal of FIG. 15;

FIG. 21 is a rear view of the height adjustable soccer ball goal of FIG. 15;

FIG. 22 is a bottom view of the height adjustable soccer ball goal of FIG. 15.

In the following detailed description, spatially orienting terms are used such as "left," "right," "vertical," "horizontal," and the like. It is to be understood that these terms are used for convenience of description of the preferred embodiments by reference to the drawings. These terms do not necessarily describe the absolute location in space, such as left, right, upward, downward, etc., that any part must assume.

DETAILED DESCRIPTION OF THE PREFERRED EMBODIMENTS

Figure 3:
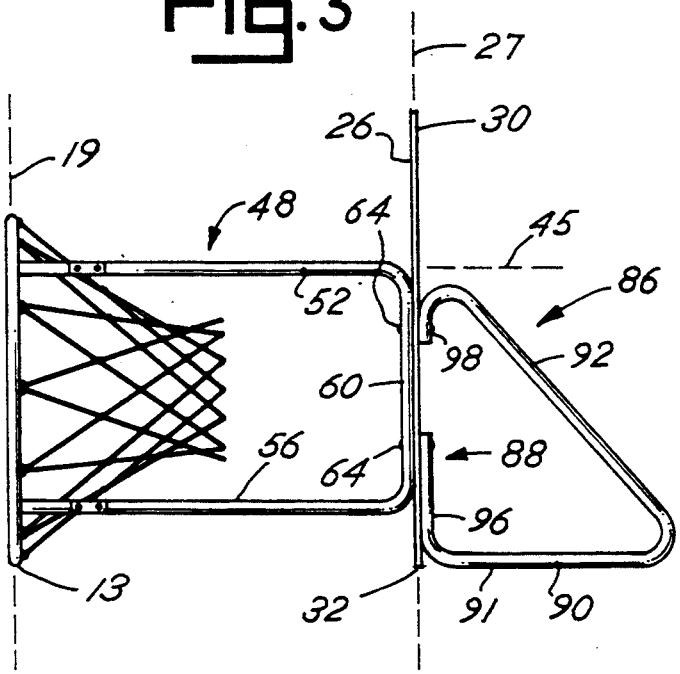
FIG. 3 is a right side view of the soccer ball goal of FIG. 1.
Figure 8:
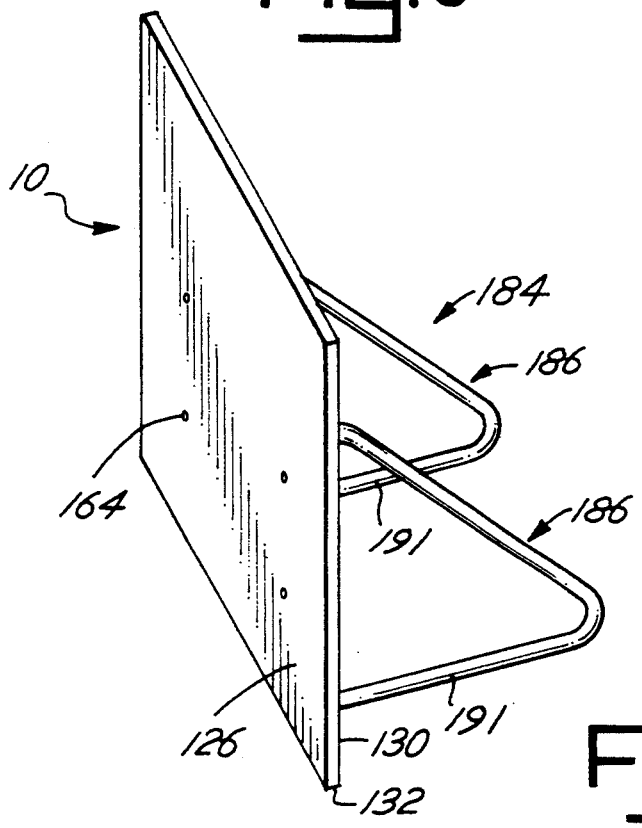
FIG. 8 is a top perspective view of a ricochet board for use in connection with the soccer ball goal of FIG. 1.
Figure 9:
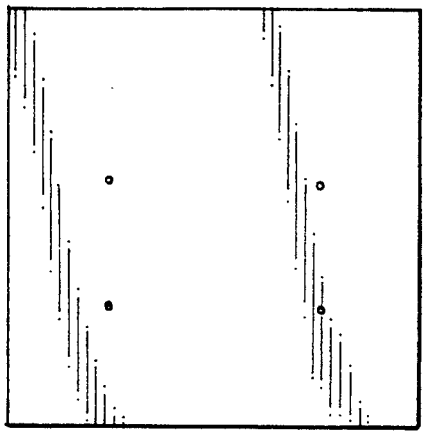
FIG. 9 is a front view of the ricochet board FIG. 8.
Figure 10:
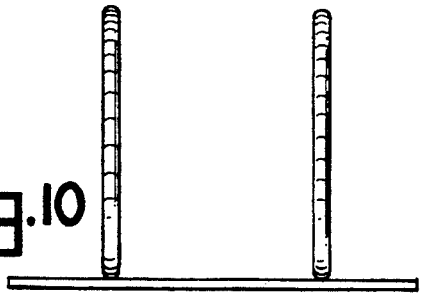
FIG. 10 is a top view of the ricochet board FIG. 8.
Figure 11:
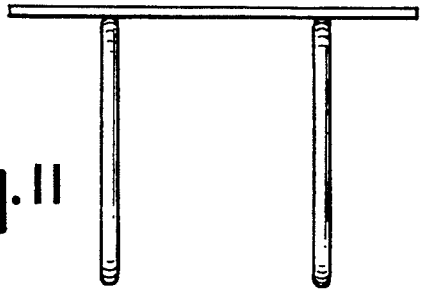
FIG. 11 is a bottom view of the ricochet board FIG. 8.
Figure 12:
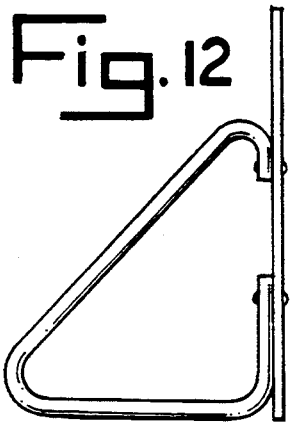
FIG. 12 is a left side view of the ricochet board FIG. 8.
Figure 13:
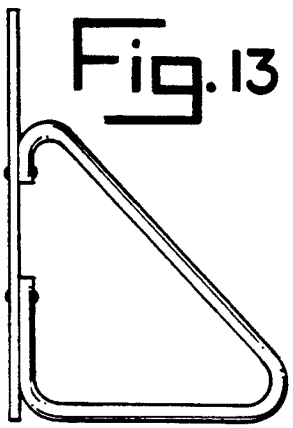
FIG. 13 is a right side view of the ricochet board FIG. 8.
Figure 14:
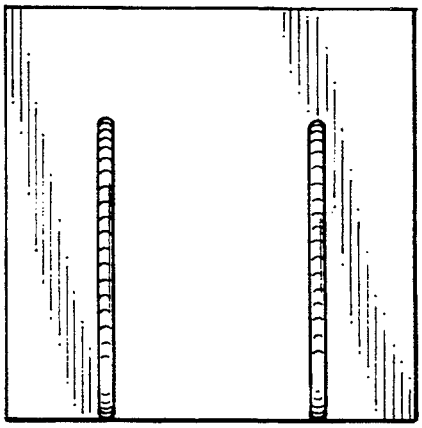
FIG. 14 is a rear view of the ricochet board FIG. 8.
Figure 15:
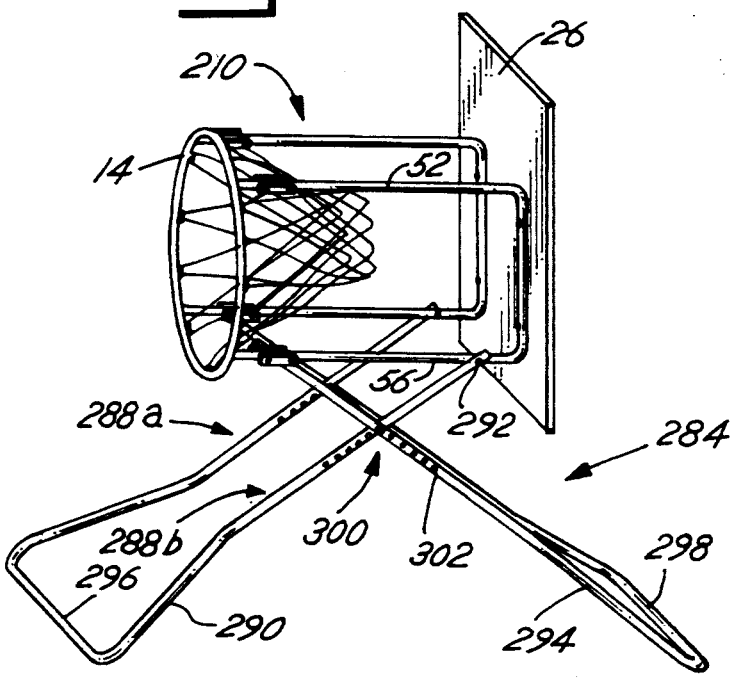
FIG. 15 is a top perspective view of an embodiment of a height adjustable soccer ball goal.
Figure 16:
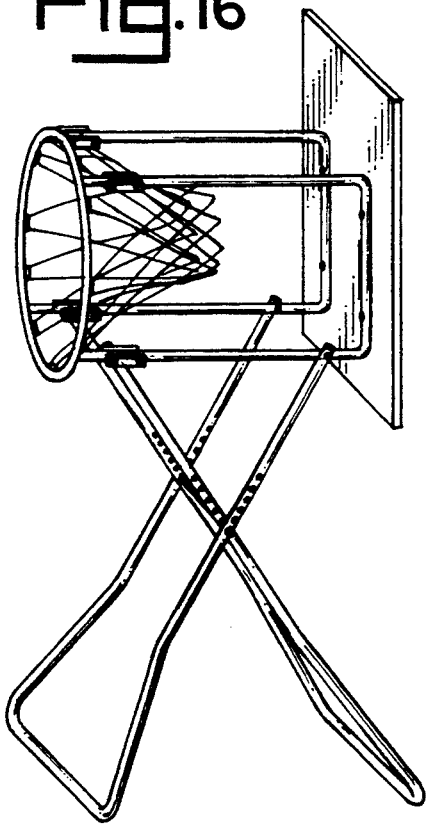
FIG. 16 is a top perspective view of the height adjustable soccer ball goal of FIG. 15 at a different height than is illustrated in FIG.
Figure 17:
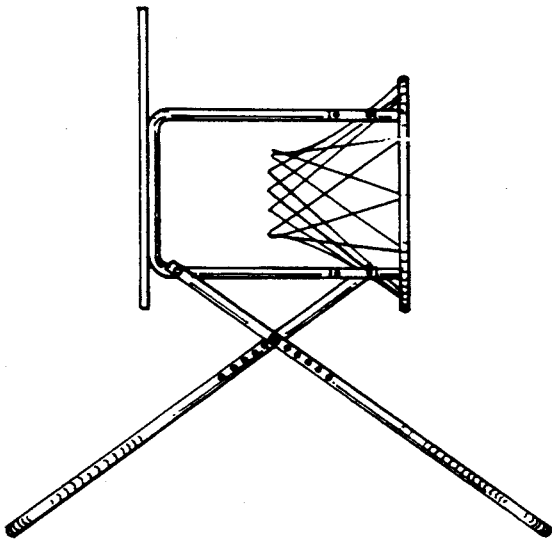
FIG. 17 is a left side view of the height adjustable soccer ball goal of FIG. 15.
Figure 18:
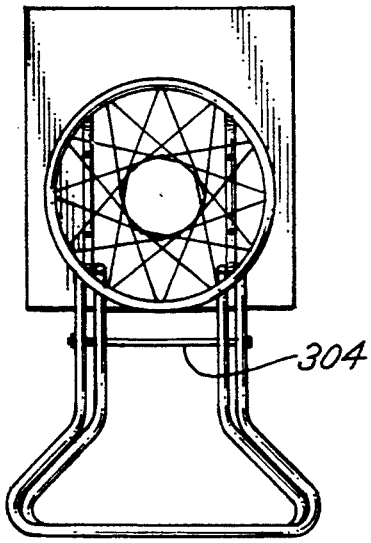
FIG. 18 is a front view of the height adjustable soccer ball goal of FIG. 15.

Referring to FIGS. 1–7, a first embodiment of soccer ball goal 10 includes a metal hoop 14 having a circular aperture 16. Aperture 16 is large enough to admit passage of a conventional soccer ball (illustrated diagrammatically and by reference numeral 412 in FIG. 23) which is typically eight inches in diameter. Preferably, the hoop 14 is in the form of a conventional basketball hoop which has an inside aperture diameter of eighteen inches. Hoop 18 has a center axis 17 (FIG. 2) and is planar, i.e., being flat or having a low profile, and having a symmetrical form with respect to a plan 19 (FIG. 3).

The hoop 14 carries a net 18 which is open at both ends and has a reduced diameter at its distal end 22. The proximal end of net 18 is secured to conventional net hooks 15 which are welded to the backside of hoop 14.

Spaced behind net 18 is a backboard 26 which is planar, i.e., being flat or having a low profile, and having a symmetrical form with respect to a plane 27 (FIG. 3). Backboard 26 has a front face 28, a back face 30 and a bottom surface 32 extending perpendicularly between the front and back faces. The front face 28 is of a size at least as large as the area of the circular aperture 16 of the hoop 14.

The backboard 26 is formed of a rigid material such as plywood, fiberglass, or plexiglass and can be in the form of a commercially available basketball backboard. Besides providing structural support for hoop 14, the backboard 26 evokes an image of a basketball game and makes the goal 10 more appealing to individuals who are familiar with the game of basketball.

A frame 40 connects the hoop 14 directly to the backboard 26. The frame 40 includes four linear transverse rods 44 that rigidly connect the circular hoop 14 to the backboard 26 and maintain the proper orientation between the hoop 14 and the backboard. In particular, the transverse rods 44 maintain the hoop 14 in a plane 19 (FIG. 3) that is spaced from and parallel to the plane 27 of the backboard 26, and at a predetermined distance from the backboard front face 28. Hence, balls rebound off of the backboard 26 after being kicked through the hoop 14.

The transverse rods 44 form part of first and second U-shaped brackets 48. As can best be seen in FIG. 3 and FIG. 6, each U-shaped bracket 48 includes an upper transverse rod 52, a lower transverse rod 56, and a third rod 60. The third rod 60 extends between the distal ends of the upper and lower transverse rods 44 of a respective U-shaped bracket 48. Preferably, the upper transverse rod 52, the lower transverse rod 56, and the third rod 60 in a respective bracket 48 are formed from a single piece of material which is formed in a "U" shape as illustrated. The third rod 60 from each U-shaped bracket 48 is connected to the backboard front face 28 by a plurality of fasteners 64, such as bolts or rivets, that extend through reciprocal apertures (not shown) in the third rod 60 and the backboard 26. When the third rod 60 is connected to the backboard front face 28 in this manner, the longitudinal axis 45 (FIG. 3) of the transverse rods 44 extend parallel to hoop center axis 17 (FIG. 2) and perpendicularly to the plane of backboard front face 28.

The proximal ends of the transverse rods 44 are fixedly connected to the hoop 14. For this purpose, the hoop 14 includes four connecting rods 68 which are welded to and extend perpendicularly from the hoop 14 in alignment with the transverse rods 44. A plurality connecting members 72 secure the connecting rods 68 to different ones of the transverse rods 44. Alternatively, the proximal ends of transverse rods 44 may be welded directly to hoop 14.

Figure 1:
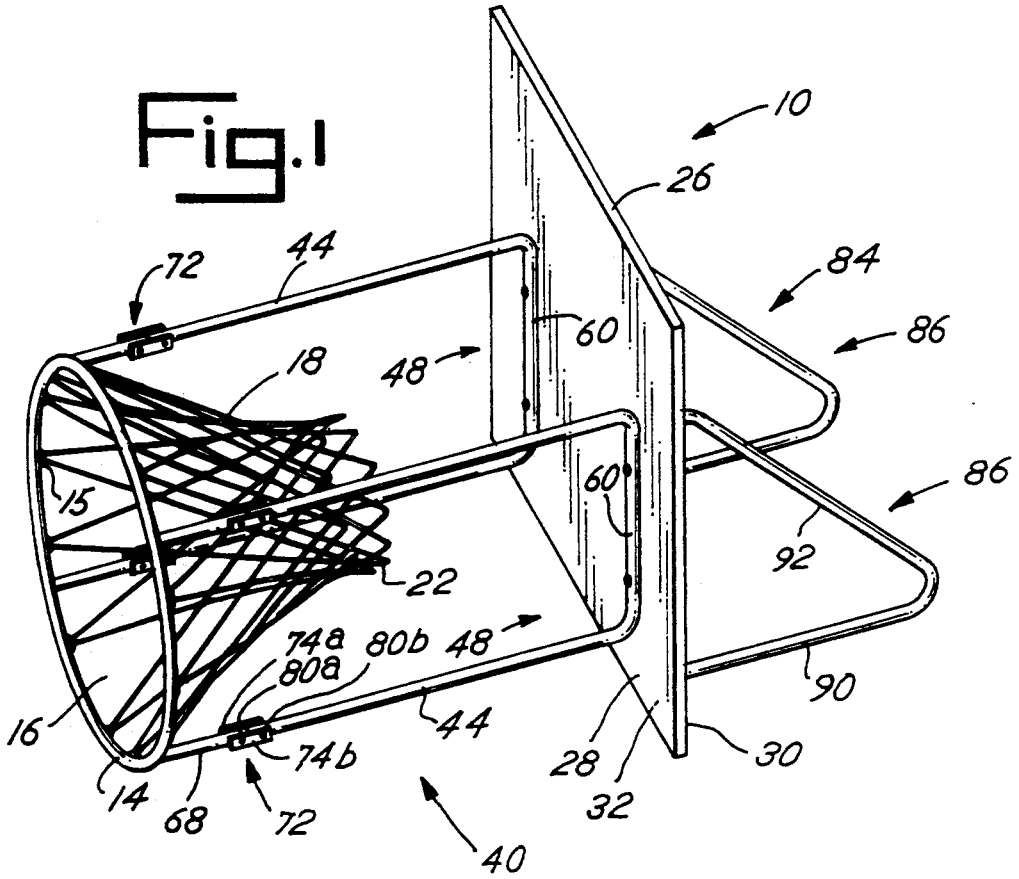
FIG. 1 is a top perspective view of an embodiment of a soccer ball goal according to the present invention.
Figure 2:
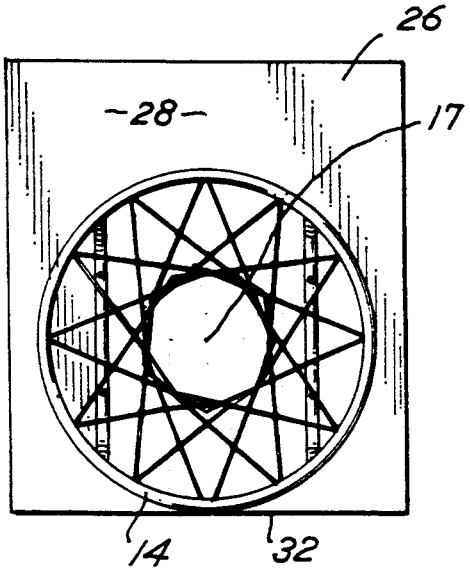
FIG. 2 is a front view of the soccer ball goal of FIG. 1.

As can be seen in FIG. 1, each connecting member 72 includes a pair of connecting plates **74*a*, 74*b* and a pair of fasteners 80*a*, 80*b*, such as bolts or rivets. The connecting plates 74*a*, 74*b* extend between the connecting rod 68 and the transverse rod 44 and are positioned on opposite sides of the rods 44, 68. One of the threaded fasteners 80*a* attaches the connecting plates 74 to the end of the connecting rod 68 and the other threaded fastener 80***b* attaches the plates 74 to the second end of the transverse rod 44.

The soccer ball goal 10 further includes a playing surface engaging structure 84 for maintaining the backboard 26 substantially perpendicular to the playing surface, such as the ground or a floor. Structure 84 also provides an area where the unit 10 may be secured to the playing surface by spikes (not shown) driven into the soil or screws (not shown) driven into the floor, depending on the type of playing surface. Also, structure 84 provides an area for weights, such as sand bags, to be used to secure the unit 10 from movement during play.

The playing surface engaging structure 84 includes first and second triangular brackets 86 which are attached to the backboard back face 30. As can best be seen in FIG. 3 and FIG. 6, each triangular bracket 86 includes first and second elongated members 88, 90 joined at one end to form a right angle and a third elongated member 92 extending at an acute angle toward back face 30 from one end of the first elongated member 90. In the drawings, the first elongated member 88 is illustrated as consisting of first and second sections 96, 98, the first section 96 being connected to the second elongated member 90 and the second section 98 being connected to the third elongated member 92. Alternatively, the second first elongated member 88 can be formed from a single piece of material that extends between the second and third members 90,92.

Reciprocal apertures (not shown) are formed in the backboard 26 and the first elongated member 88 to permit the triangular shaped bracket 86 to be attached to the back face 30 of the backboard 28 using fasteners. In the drawings, a single set of fasteners 64 has been used to connect both the U-shaped brackets 48 and the triangular shaped brackets 86 to the backboard 26. Alternatively, separate fasteners can be used to attached the triangular shaped brackets 84 to the backboard 26. In particular, it may be desirable to position the triangular brackets 86 close to the edges of the backboard 26 for increased stability.

Second elongated members 90 carry a bottom support surface 91. When the triangular brackets 86 are attached to the backboard 26, bottom support surface 91 are in the same plane as the backboard bottom surface 32. Backboard bottom surface 32 forms part of the playing surface engaging structure. In addition, hoop 14 includes a lower outer surface 13 which is in the same plane as backboard bottom surface 32 and bottom support surface 91 Lower outer surface 13 engages the playing field and forms part of the playing surface engaging structure. The second elongated members 90, the backboard bottom surface 32, and the bottom of the hoop 14 engage the playing surface, thereby providing stability to the goal 10 and maintaining the hoop 14 and the backboard 26 substantially perpendicular to the playing surface. Hoop 14 may be spaced above the playing field, if desired, and then surface 13 will not form part of the playing surface engaging structure. Alternatively, triangular brackets 86 may be removed from the backboard and allowing only lower outer surface 13 and bottom surface 32 to form the playing surface engaging structure.

Referring to FIGS. 8–14, a rebounding wall or ricochet board 10 may be used in connection with the soccer ball goal 10 of FIG. 1. The ricochet board 110 can be positioned relative to the soccer ball goal 10 to permit a player to rebound shots into the goal 10. The ricochet board 110 includes a backboard 126 having a bottom surface 132 and a playing surface engaging structure 184 in the form of a pair of triangular shaped brackets 186, having bottom support surface 191, which maintain the backboard substantially perpendicular to the playing surface. Surfaces 132, 191 are disposed in the same plane. The brackets 186 are connected to the back face 130 of the backboard 126 by a plurality of fasteners such as bolts or rivets. The construction of the rebounding wall 110 and its components is essentially the same as the soccer ball goal 10 and, hence, it will not be described in further detail.

Referring to FIGS. 15–22, an embodiment of a height adjustable soccer ball goal 210 is illustrated. One difference between the first and second embodiments lies in the playing surface engaging structure. In the second embodiment, the playing surface engaging structure 284 includes a structure for varying the height of the hoop 14 and backboard 26 with respect to the playing surface. More specifically, the playing surface engaging structure 284 includes two pairs of legs 288*a*, 288*b* extending from the bottom of the goal 210. The legs in a respective pair are pivotly connected about their middles to form an X-shaped frame. The point at which the legs in a pair are connected can be varied to adjust the height of the hoop 14 and backboard 26, as explained below.

Each pair of legs 288 includes a first leg 290 having its first end pivotly connected to one of the lower transverse rods 56 near the backboard 26 by a fastener 292 such as a threaded fastener or a rivet. Each pair of legs 288 also includes a second leg 294 having its first end pivotly connected to a respective lower transverse rod 56 near the hoop 14. One of the fasteners 80 from the connecting member 72 is used for connecting the second leg 294 to the lower transverse rod 56.

The second ends of the legs 290, 294 engage the playing surface for supporting the hoop 14 and the backboard 26 at a preselected height above the playing surface. First and second support rods 296, 298 connect the second ends of the first legs 290 and the second legs 294, respectively, to provide additional stability to the height adjustable soccer ball goal 210.

A connecting structure 300 pivotally connects the legs 290, 294 to form the two X-shaped frames. Advantageously, the point at which the legs 290, 294 are joined can be varied to adjust the height of the backboard 26 and hoop 16 with respect to the playing surface. For this purpose, each leg 290,294 includes a plurality apertures 302 disposed along its middle portion. A fastener 304 (FIG. 18), such as a bolt, extends through the apertures 302 to pivotally connect the legs about their middle portions. Although a single elongated fastener 304 has been illustrated, separate fasteners can be employed for joining the legs in each pair.

The height of hoop 14 of the embodiment of FIG. 1 may be adjustable as well. Fasteners 64 (FIG. 3), may be replaceably mounted in different apertures (not shown) in backboard 26 so as to move U-shaped brackets 48 to a different height.

Figure 23:
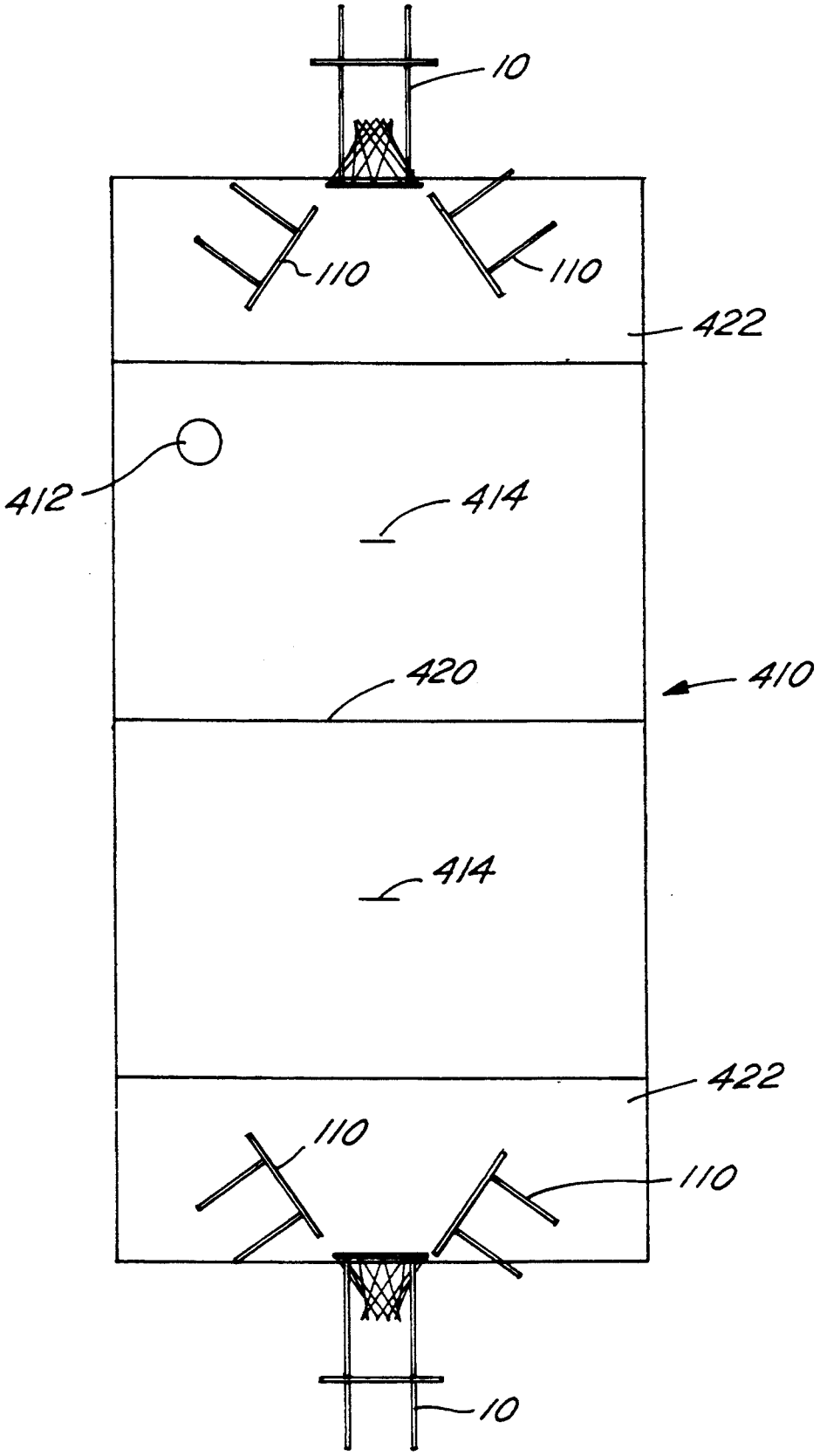
FIG. 23 is a diagrammatic illustration of a soccer style game employing the soccer ball goal.

Referring now to FIG. 23, an example of a soccer style game utilizing the soccer ball goal 10 and the ricochet wall 110 is described. Ideally, a basketball court is utilized to establish a playing field 410 and the out-of-bounds lines. Using a basketball court is advantageous because it permits the game to be played by a small number of players, and also because both indoor and outdoor basketball courts are readily accessible at a variety of facilities.

When a full-court game is played, a soccer ball goal 10 and a pair of ricochet boards 110 are positioned at opposing ends of the court. Players move a conventional soccer ball 412 with their feet and points are scored by kicking the ball into the opposing team's goal. Points are kept according to a predetermined scoring system such as awarding two points if the ball is banked off a ricochet board and through the hoop and awarding one point if the ball is kicked directly through the hoop. A conventional soccer ball is 8" in diameter, however, other sizes of balls may be used.

As in soccer, players cannot use their hands to move the ball. If a player moves the ball with his hands, the opposing team is awarded the ball. The playing field 410 can include foul lines 414 disposed between the goals 10 and the center court line 420. Free kick shots are given from the foul line 414 when a player is fouled. The game can be divided into predetermined time intervals such as four twenty-minute quarters. The playing field 410 can also be provided with a 10 foot zone 422 around each goal. Players are only permitted in the 10 foot zone when the ball enters the 10 foot zone. A team is penalized if one of its players enters the 10 foot zone without the ball.

The rules of the game can take numerous variations. For example, when a small number of players are available, such as one to three players per team, a half-court game can be played. A half-court game is played using one of the goals 10 and only half of the playing field 410. One team functions as an offensive team while the other team plays defense. Only the team playing offense can score points. Each team can be given a set amount of time to be on offense. For example, the teams can alternate between offense and defense at a predetermined interval such as every five minutes. When a team is on offense, its players try to score as many points as possible in the allotted time. The players on the defensive team guard the offensive players and try to prevent the offensive team from scoring goals. Defensive players are not permitted to stand in front of the goal except when guarding an offensive player.

Ideally the game is played on a full court basis. When a full-court is played, each team defends one of the goals and tries to score points by kicking the ball into the other team's goal. The players on each team can be divided in a number of variations. For example, the game can be played by permitting each player to function both as an offensive player and a defensive player. Alternatively, each teams can be divided into offensive and defensive players. For example, if there are five players per team, each team can include two offensive players, two defensive players and a mid-fielder who plays both offense and defense. Similarly, if there are six players per team, each team can be divided into three offensive players, a mid-fielder, and defense, and two defensive players. Each team can also be divided into three offensive and three defensive players. During a full court game both offensive and defensive players can score goals by kicking the ball through the opponent's goal. However, the defensive players must remain on the side of the court contain their team's goals and the offensive players must remain on the opponent's side of the court.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A goal positionable on a playing surface for use with a ball, comprising, a planar hoop having a circular aperture of a size large enough to admit passage of the ball;

a backboard having a planar front face of an area larger than the area of the circular aperture of said hoop;

a frame rigidly connecting said hoop to said backboard, said frame maintaining said hoop in a plane spaced apart from and parallel to the plane of said front face of said backboard, said frame maintaining said hoop a predetermined distance from said backboard front face; and playing surface engaging means for engaging the playing surface and maintaining said backboard and said hoop in planes substantially perpendicular to the plane of the playing surface.

2. A goal as set forth in claim 1, wherein said frame comprises a plurality of linear rods extending between said circular hoop and the front face of said backboard.

3. A goal as set forth in claim 2, wherein each of said rods has a longitudinal axis disposed parallel to the center axis of said hoop and perpendicular to the plane of said backboard front face.

4. A goal as set forth in claim 1, wherein said frame comprises first and second U-shaped brackets, each U-shaped bracket having a first rod, a second rod and a third rod, each rod having first and second ends, the first ends of said first and second rods being connected to opposite ends of said third rod, the second ends of said first and second rods are connected to said hoop and said third rod is connected to said backboard front face.

5. A goal as set forth in claim 4, wherein said first and second rods in each bracket extend parallel to each other and substantially perpendicular to a respective third rod.

6. A goal as set forth in claim 1, and further including means for varying the height of said hoop with respect to the playing surface.

7. A goal as set forth in claim 1, wherein said playing surface engaging means includes a means for varying the height of said hoop with respect to the playing surface.

8. A goal as set forth in claim 7, wherein said frame comprises a plurality of transverse rods connecting said circular hoop to said backboard, each rod having a first end connected to said hoop and a second end connected to said backboard; and wherein said playing surface engaging means comprises two pairs of legs and a connecting means, each leg having a first end, a second end and a middle portion, one leg from each pair having its first end connected to a transverse rod near the backboard and the other leg in respective pair having its first end connected to a respective transverse rod near the hoop, said connecting means connecting each pair of legs near their middle portions to form an X-shaped frame such that the second end of each leg in a respective pair engages the playing surface, the point at which said legs are joined being variable for adjusting the height of the backboard with respect to the playing surface.

9. A goal as set forth in claim 8, further including a first support rod connecting the second ends of said first legs and a second support rod connecting the second ends of said second legs.

10. A goal as set forth in claim 8, wherein each leg includes a plurality apertures disposed about its middle portion and said connecting means comprises at least one fastener extend through said apertures and connecting each pair of legs near to form a pair of X-shaped frames.

11. A goal as set forth in claim 1 wherein said playing surface engaging means is disposed to the backside of said backboard.

12. A goal as set forth in claim 1, wherein said backboard includes a back face and a bottom surface extending perpendicularly between said front and back faces, and wherein said playing surface engaging means comprises said bottom surface and a frame extending from said back face, said frame including at least one playing surface engaging member extending from said backboard back face and having a support surface coplanar with said bottom surface.

13. A goal as set forth in claim 12, wherein said hoop includes a lower outer surface; and wherein said playing surface engaging means further comprises said lower outer surface.

14. A goal as set forth in claim 1, wherein said backboard includes a bottom support surface; and wherein said hoop includes a lower outer support surface; and wherein said playing surface engaging means comprises said bottom support surface and said lower outer surface.

15. A goal as set forth in claim 12, wherein said frame comprises a pair of brackets, each bracket including first and second elongated members joined at one end to form a right angle, one elongated member from each bracket being connected to said backboard back face and the other elongated member from a respective bracket extending perpendicular to said backboard back face.

16. A goal as set forth in claim 15, wherein each bracket further comprises a third elongated member, said first, second and third elongated members being connected at their ends to form a triangular shaped bracket.

17. A gaming apparatus positionable on a playing surface for use with a ball, comprising:

at least one goal, each goal including a hoop having a circular aperture large enough to admit passage of the ball;

a first backboard having a front face at least as large as the circular aperture of said hoop;

a frame rigidly connecting said hoop to said backboard said frame being adapted to maintain said hoop in a position which is in front of said backboard front face, parallel to said backboard front face, and at predetermined distance from said backboard front face; and first playing surface engaging means for maintaining said first backboard substantially perpendicular to the playing surface; and at least one ricochet board movably positionable with respect to said goal, each ricochet board including a second backboard having a front face; and second playing surface engaging means for maintaining said second backboard substantially perpendicular to the playing surface and permitting said second backboard to be movably positioned relative to the goal.

18. A gaming apparatus as set forth in claim 17, wherein said frame comprises a plurality of rods connecting said circular hoop to said first backboard, each rod having a first end connected to said hoop and a second end connected to said backboard.

19. A gaming apparatus as set forth in claim 18, wherein said rods extend perpendicular from said first backboard front face.

20. A gaming apparatus as set forth in claim 17, wherein said frame comprises first and second U-shaped brackets, each U-shaped bracket having a first rod, a second rod, and a third rod, each of said rods having first and second ends, the first ends of said first and second rods being connected to opposite ends of said third rod, the second ends of said first and second rods being connected to said hoop, said third rod being connected to said first backboard front face.

21. A gaming apparatus as set forth in claim 20, wherein the first and second rods in each bracket parallel to each other and substantially perpendicular to a respective third rod.

22. A gaming apparatus as set forth in claim 17, wherein each of said backboards includes a back face and a flat bottom surface extending perpendicularly between said front and back faces; and wherein said first and second playing surface engaging means each comprise a respective bottom surface and a frame extending from a respective backboard back face, each frame including at least one playing surface engaging member extending from the back face of a respective backboard in the same plane as said backboard bottom surface.

23. A gaming apparatus as set forth in claim 22, wherein said first playing surface engaging means further comprises said hoop.

24. A gaming apparatus as set forth in claim 22, wherein said first and second frames each comprise a pair brackets, each bracket including first and second elongated members joined at one end to form a right angle, one elongated member from each bracket being connected to said backboard back face and the other elongated member from a respective bracket extending perpendicular to said backboard faces in the same plane as said backboard bottom surface.

25. A gaming apparatus as set forth in claim 24, wherein each bracket further comprises a third elongated member, said first, second, and third elongated members being connected at their ends to form a triangular shaped bracket.

* * * * *